US006695132B2

(12) United States Patent
Cook et al.

(10) Patent No.: US 6,695,132 B2
(45) Date of Patent: Feb. 24, 2004

(54) CONVEYOR SYSTEM FOR CAN END CONVERSION SYSTEMS

(75) Inventors: Steven T. Cook, Bellbrook, OH (US); James R. Schubert, Dayton, OH (US); Stephen P. Common, Dayton, OH (US)

(73) Assignee: Dayton Systems Group, Inc., Miaimisburg, OH (US)

( * ) Notice: Subject to any disclaimer, the term of this patent is extended or adjusted under 35 U.S.C. 154(b) by 0 days.

(21) Appl. No.: 10/125,859

(22) Filed: Apr. 19, 2002

(65) Prior Publication Data

US 2002/0153230 A1 Oct. 24, 2002

Related U.S. Application Data

(62) Division of application No. 09/449,269, filed on Nov. 24, 1999, now Pat. No. 6,405,853.

(51) Int. Cl.[7] ..... B65G 23/00

(52) U.S. Cl. ..... 198/832.1; 72/361

(58) Field of Search ..... 198/803.7, 803.8, 198/803.15, 570, 867.06, 803.12, 832.1, 343.1, 346.3; 72/361, 419, 426; 413/56, 62

(56) References Cited

U.S. PATENT DOCUMENTS 4,568,230 A * 2/1986 Brown ..... 413/66
4,799,846 A * 1/1989 Wissman et al. ..... 413/66
4,807,421 A * 2/1989 Araki et al. ..... 53/167
4,946,028 A * 8/1990 Eichmann et al. ..... 198/688.1
5,158,410 A * 10/1992 Hunt ..... 413/56
5,813,513 A * 9/1998 Taube ..... 198/803.14
6,405,853 B1 * 6/2002 Cook et al. ..... 198/803.8

* cited by examiner

*Primary Examiner*—Khoi Tran
(74) *Attorney, Agent, or Firm*—Jos. G. Nauman

(57) ABSTRACT

The transfer conveyor system utilizes at least one endless conveyor belt of reinforced flexible rubber-like material with cogs or teeth on its underside and with a series of nests fitted into holes in the belt. Nests for carrying can end shells are attached at their opposite edges to the belt. The belt is supported by and routed around an idler drum, located outside the press frame posts and by a toothed drive drum located within the press frame adjacent the opposite frame posts. Progressive conversion tooling for making shells into completed easy-open can ends is located between the posts above and below upper and lower tooling sets. The drive drum is provided with circumferential teeth for a positive drive to the belt. Attachments of nests to the belt are located on transverse center lines which permit the flat nests to travel around the end turns of the belts. Shells are positively seated into the nests and held by a circular array of independent flexible stepped fingers as the nests are transferred through the conversion tooling. Completed ends are carried around the drum at the end of the upper flight, and the ends are ejected from the nest rings and moved [as by force from air streams] along a table or chutes. These chutes receive the ends from the lower or return flight of the conveyor, providing a compact (end-to-end) conveying system.

7 Claims, 10 Drawing Sheets

37A
85B
85S
85R
85H 85H
13
37A
37B
88
18
55
81
70
55T
10
38B
36
35
30
38A
85
12
60A
60B
68
78
145
154
147
148
60
83
VB
58
57

CONVEYOR SYSTEM FOR CAN END CONVERSION SYSTEMS

This is a division of application Ser. No. 09,449,269 filed Nov. 24, 1999 now U.S. Pat. No. 6,405,853.

FIELD OF THE INVENTION

This invention relates to conveyor systems for moving can end parts, namely shells, through end conversion apparatus wherein the shells are scored, sometimes embossed, and have an operating tab secured in position with respect to a separable pouring panel.

BACKGROUND OF THE INVENTION

Several forms of conveying systems have been, and presently are, used in conversion presses to carry shells through and between tooling stages at which operations are performed on the shells. A rotary tooling system was widely used in the beginning of the manufacturing of easy-open ends. Such system was supplied with tabs made on different equipment and fed into the rotary tooling from a magazine type supply. Those systems are presently considered as outdated, and those which remain are devoted to converting some specialty ends. A nest device used in the rotary system has three movable fingers to hold the end essentially in the nest center. In reality the two strongest springs overcome the weakest and hold the end against that outside diameter, actually off center. The nest end location with respect to the tooling stations around the rotatable table, and more critically between stations, is controlled by the condition of an indexing gear box.

Some conversion systems, principally used for specialty ends, employ a transfer bar type of mechanism for moving the parts though the stations of the end conversion tooling. A typical example is shown in U.S. Pat. No. 3,999,495. These are generally considered as relatively slow in operation.

Continuous conveyor belts predominate in the types of end conversion equipment presently marketed. Such continuous belts are presently the choice for several systems designed for the large volume beer/beverage type of ends. U.S. Pat. No. 3,812,953 shows a typical rubber/fabric type of belt, and U.S. Pat. No. 5,158,410 shows a typical metal (usually stainless steel) type of belt. Such continuous belts do operate at higher speeds, but they generally utilize a vacuum system to hold the ends in place in openings in the belts as these parts travel through the tooling; this usually produces an additional load on the belt drive, and tends to collect dirt which poses another impediment. Furthermore, there have been ongoing problems involving poor belt life, difficulties in forming a splice when such belts are replaced, or threading a continuous belt about drive and take-up drums and through the tooling as part of the belt replacement process.

Thus, vacuum hold-down systems for keeping shells in position in holes of a belt (as in the prior art) have been found to be expensive and dirty, and to impose an extra load on the belt movement which requires extra torque from the belt drive and additional wear along the belt. The elimination of vacuum hold-down systems along the belt through the various stations of tooling will provide a cost savings both in construction operation and in later maintenance.

Another problem has arisen from the need to keep round shells from rotating in the end carrying holes in the belts. U.S. Pat. Nos. 4,799,846 and 4,946,208 disclose efforts to avoid such turning of the shells and/or ends. Namely U.S. Pat. No. 4,799,846 discloses end shell carriers fitted to a continuous belt, and U.S. Pat. No. 4,946,028 discloses roughened rims surrounding the shell-receiving opening, in a continuous belt. Thus, it has been recognized that turned ends between work stations have been a long time cause of spoiled ends. A system which will positively retain the ends against rotation, without vacuum, is highly desirable.

U.S. Pat. No. 3,196,817 discloses a multi-carrier conveyor system, one of which was designed and operated for some time about forty years ago. The individual carriers are attached to a pair or conveyor chains which are advanced intermittently to move the carriers along the tooling stations of the end conversion tooling, in synchronism with sets of reciprocating press rams/platens which close and open the tooling at the successive stations. A lost motion type of connection between the carriers and the chains allows for substantial relative motion of the carriers, into and out of receptors which locate the carriers (and thus the shells and/or ends) relative to the upper and lower tooling. Such connections inherently introduce play in the fore/aft connections by which the chains advance the carriers, thus slowing the operation and placing additional centering responsibility on the receptors for consistent proper alignment of the shells and ends with respect to the tooling at each station. This system used spring finger for retaining parts in the carriers, similar to the retainers used in the aforementioned rotary systems.

SUMMARY OF THE INVENTION

The transfer conveyor system of the present invention utilizes a conveyor comprising at least one continuous belt of reinforced flexible rubber-like material, with cogs or teeth on its underside and with a series of nests which fit into holes in the belt. The nests are attached at their opposite edges to the positively driven, intermittently advancing, belt.

The belt is supported by and routed around an idler drum, located outside the press frame posts next to a down-stacker mechanism, and a drive drum located within the press frame adjacent the opposite frame posts. The progressive end conversion tooling for making shells into completed easy-open can ends is located between the posts along (above and below) the upper and lower tooling sets. The tab making tooling is preferably located between the drive drum and the other frame posts, and the carrying strip of formed tabs is routed back to the main tooling station where the tabs are applied to the ends. The drive drum and idler drum are provided with circumferential tooth configurations which form a positive drive to the belt. The press includes power take-off mechanisms which drive and synchronize the shell feeding, tab strip feeding, and other mechanisms.

The attachments between the nests and belt are located on transverse center lines (perpendicular to the path of belt travel), which attachments permit the generally flat and rigid nests to travel around the end turns of the belts, and to carry the parts within the nests about this turn. These attachments thus allow for limited and controlled relative movement between the nests and the belt, only in directions parallel to the plane of motion of the belts, but not in directions perpendicular (up and down) with respect to the belt upper surface.

The active (upper) flight of the belt is lifted and moved incrementally forward when the press is opened, to locate the nests successively in alignment with progressive stations of can end conversion tooling. The flight is then lowered to locate the nests onto the lower tooling aligned precisely with respect to the tooling before it closes. Each nest comprises a positive holding device in the form of a circular array of flexible fingers in a nest ring, which array engages shells firmly at their periphery and inhibits the shells from rotating or shifting between operations. In a typical embodiment of the invention, there are plurality of nests in each of two to four lanes along the belt or belts. Shells are rotary down-stacked or loaded into the nests near the beginning of the active flight of the conveyor belt.

The shells are positively seated into the nests by applied differential air pressure, and then are mechanically positively seated into and firmly held by the circular array of independent stepped fingers as the nests are transferred through the conversion tooling. After conversion the completed ends are carried around the drum at the end of the upper flight, and the ends are ejected from the nest rings and moved [as by force from air streams] along a table or chutes to conveyers familiar in end making facilities. These chutes thus receive the ends from the lower or return flight of the conveyor, providing a compact (end-to-end) conveying system.

Also, this new belt transfer system, preferably but not necesarily usung multiple belts, lends itself to easier end size changes and even to running different sizes of ends in each lane. This is readily accomplished by attaching nests of different sizes in different ones of the lanes.

Other objects and advantages of the invention will be apparent from the following description, the accompanying drawings and the appended claims.

DESCRIPTION OF THE PREFERRED EMBODIMENT

Press & Drive

Figures 1, 14:
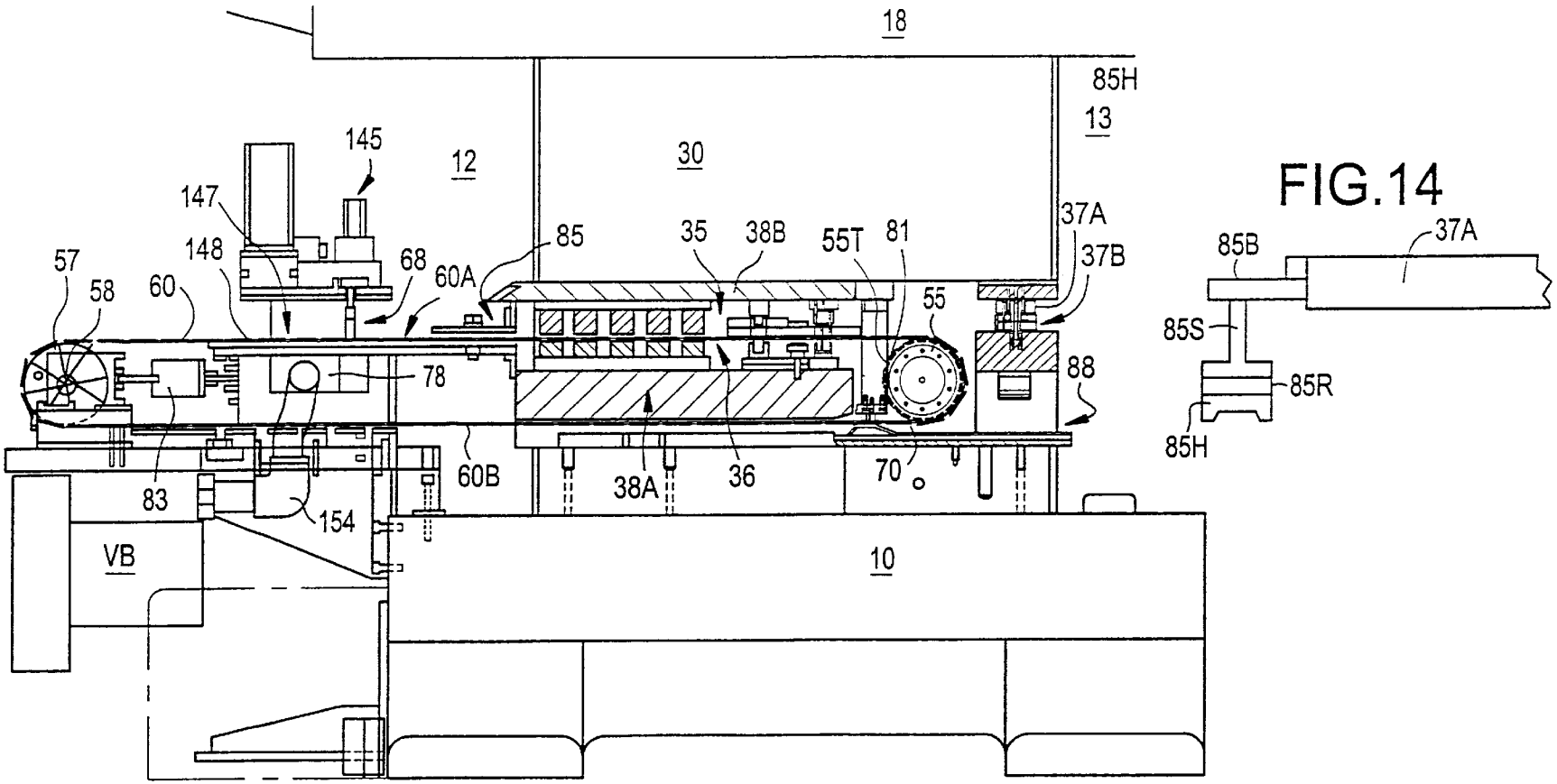
FIG. 1 is side view of the conveyor system, with portions of the parts in-feed and discharge and of the press bolster, ram, and tooling, all shown schematically.
FIG. 14 (sheet 1) is a detail view of the positive insertion mechanism.
Figure 2:
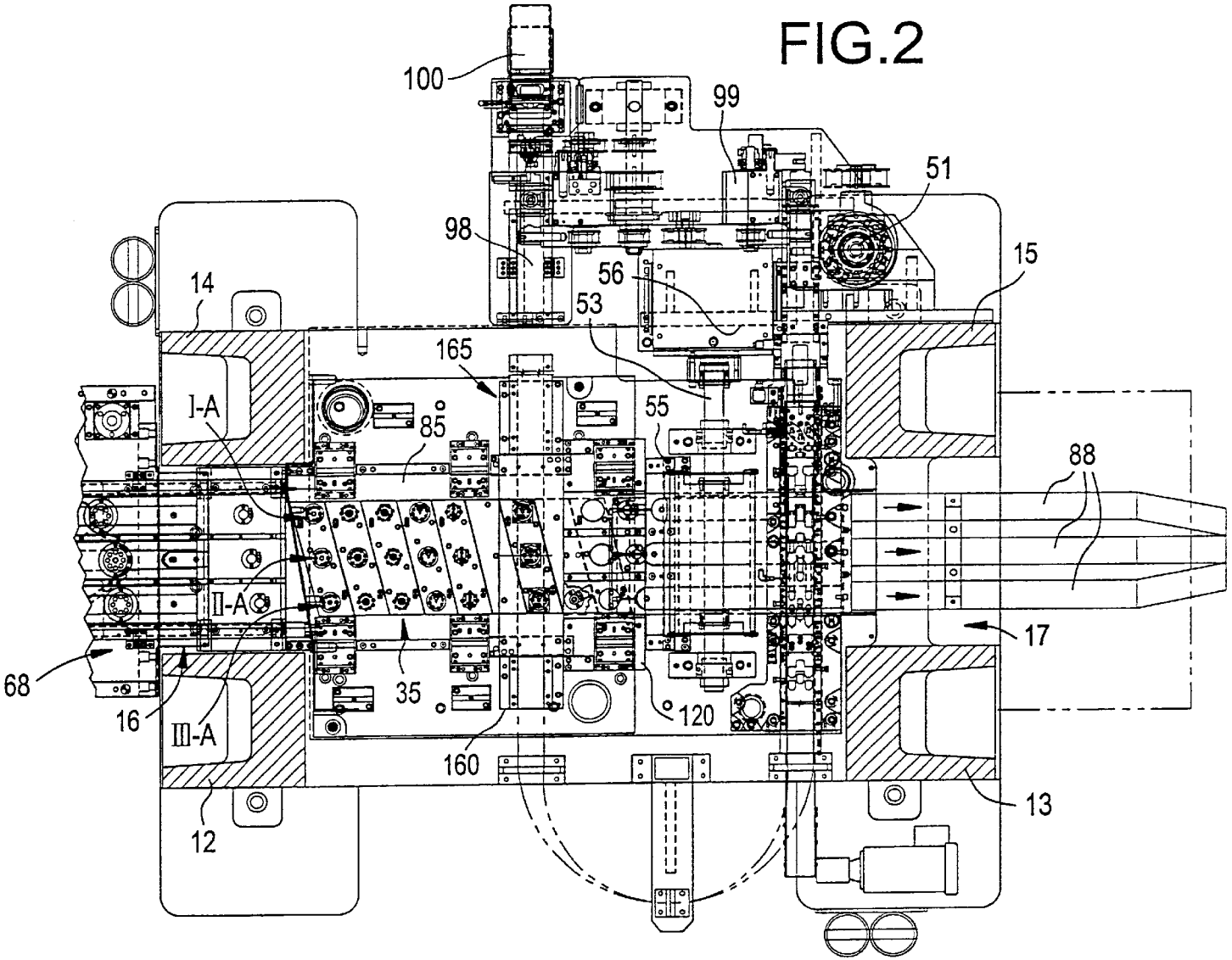
FIG. 2 is a plan view of the system including portions of the conveyor drive and the tab tooling and tab transfer mechanisms.
Figure 3:
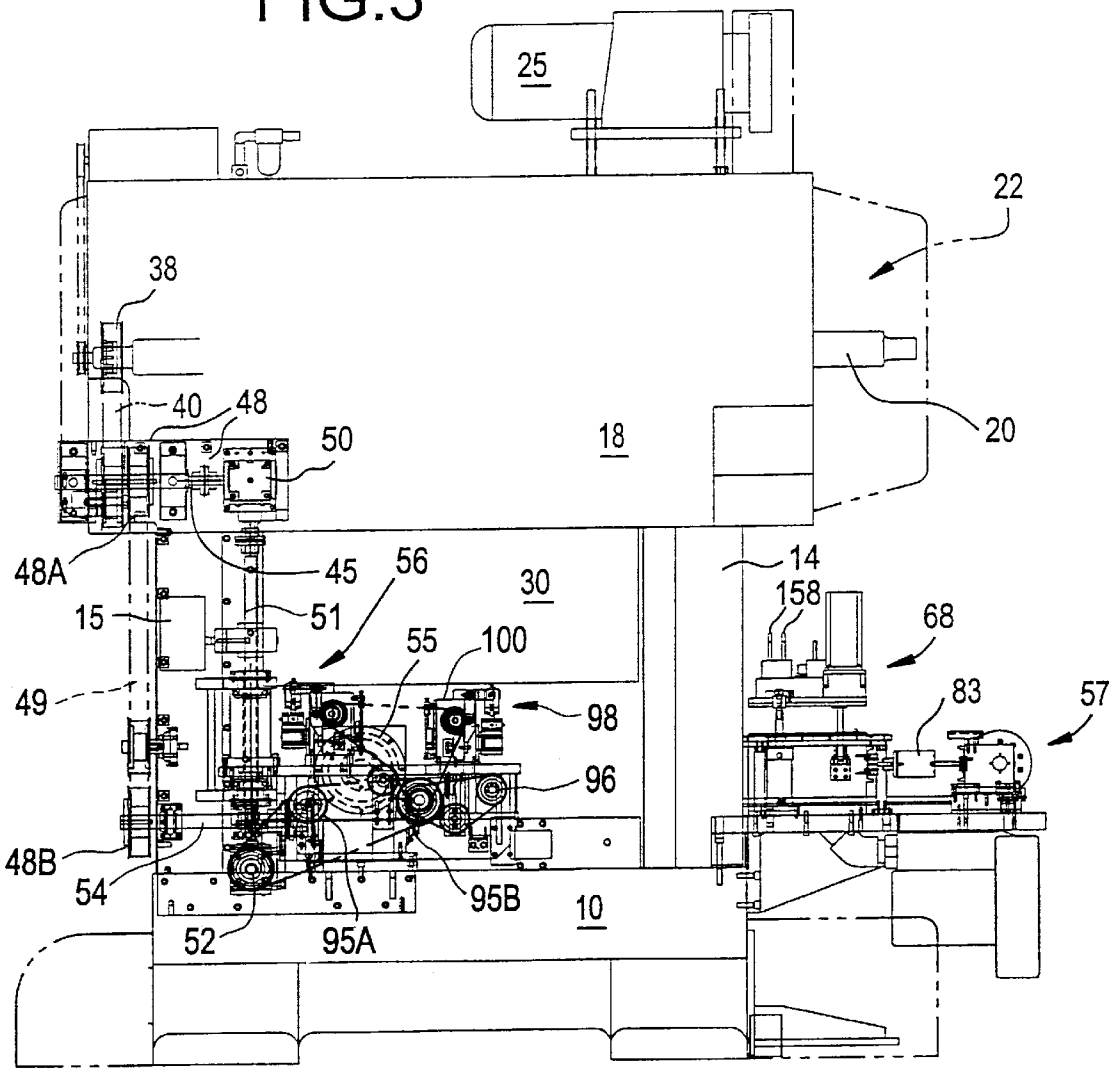
FIG. 3 is an elevation view of the rear of the press fitted with the system of the invention.

FIGS. 1, 2 and 3 show, respectively, the overall configuration of a press in accordance with the invention, and the general arrangement of the progressive tooling to work upon shells, form completed tabs from a strip of material, and attach these tabs to complete the manufacture or conversion of the shells into ends for cans and similar containers.

For purposes of this description the press illustrated in FIGS. 1, 2 and 3 is typical of a one hundred twenty five ton single acting press, and includes a bed 10, side frames including uprights or posts 12, 13, 14 and 15 defining side openings 16 and 17, and a crown 18 supported on the side frames. The crank 20 is rotatably supported in the crown, has secured to it a flywheel 22, and is belt-driven by a drive motor 25 supported on top of the crown structure. The crank is connected to the slide 30 by a pair of connecting rods (not shown), and cooperative upper and lower end tooling sets, indicated by the general reference numerals 35 and 36, are mounted on the slide and on the bed, respectively. The upper and lower tab tooling 37A, fitted to the punch plate 38A which in turn is supported on the press slide 30, and lower or die tooling 37B, fitted to a bed plate 38B on the press bolster, is mounted in the press inside posts 13 and 17 and is supplied with a continuous strip of metal (in conventional fashion) from the rear of the press (FIG. 2).

The tab tooling may be of any desired type, an example being disclosed in U.S. Pat. Nos. 5,741,105 of Apr. 21, 1998 and 5,799,816 of Sep. 1, 1998, both issued to the assignee of this application.

At the opposite side of the press from the flywheel, crank 20 is fitted with a power take-off pulley 38. Referring to FIG. 3, a belt 40 transfers power from the crank pulley 38 to a pulley 42 connected to drive a shaft 45 which is mounted in suitable bearings supported outboard from posts 13 and 15, which are part of the right hand side frame of the press as viewed from the front (see FIG. 2). Shaft 45 (see FIG. 3) is connected through a clutch and coupling 48 to a right angle intermittent drive unit 50, of conventional construction, which in turn is connected through an output clutch to a shaft 53 supported in bearings and carrying a drive drum 55 which is rotated in timed intermittent fashion, synchronized with the rotation of the crank 20 and the motion of press slide 30. At the other (or left) side of the press, outboard of the side frame and posts 12 and 14, an idler drum 57 (FIGS. 1 and 3) is supported in suitable bearings 58. Extending between the drums 55 and 57 is an endless conveyer belt 60, fitted with integral drive teeth 61. The illustrated embodiment employs a single belt with three lanes, but it should be understood that parallel multiple belts, each with one or more lanes of nests, are within the purview of this invention.

Figure 4:
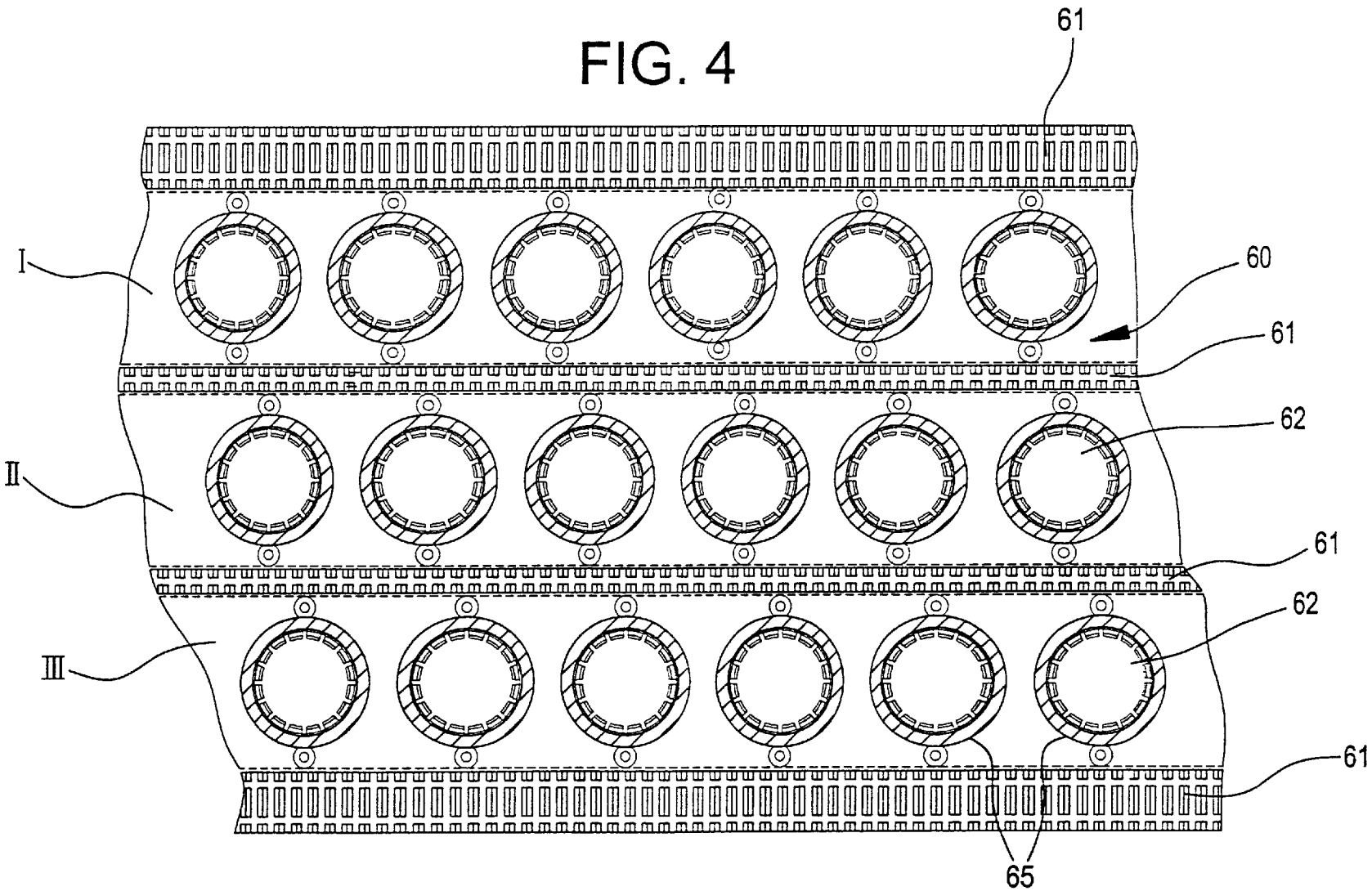
FIG. 4 is an enlarged view of a segment of a three lane transfer belt with attached nests.
Figure 12:
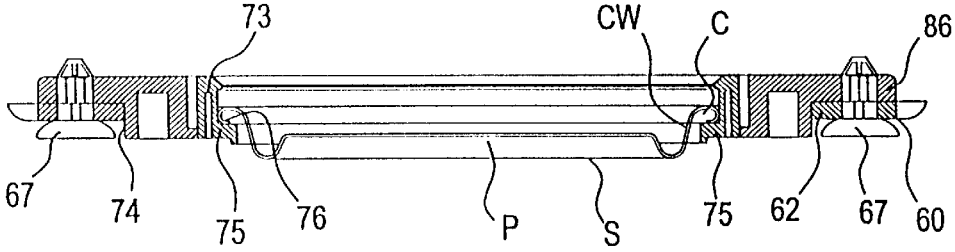
FIG. 12 is an enlarged cross-sectional view of a nest with a shell gripped therein, showing also the connection of the nest to the belt.

The belt(s) is of the endless type, as later described, and is provided with multiple rows or lanes (e.g. three lanes I, II and III in the illustrated embodiment) of openings 62 (FIG. 4) which are regularly spaced to correspond to the spacing of the centers of the tooling stations. In these openings are nests 65 of a diameter such that ears 66 on the nests overlap the edge of the openings (FIGS. 4 and 12).

The nests 65 are relatively light weight and generally rigid molded plastic parts and their spacing in the direction of motion of the belt and nests (see FIG. 4) is equal to the spacing of successive stations of the tooling. The nests 65 are placed in openings 62 along the lanes in belt 60 and attached to the belt by rivets or pins 67.

Thus shells deposited in the nests are carried by the belt through the tooling 35–36, in intermittent or step-wise fashion, synchronized to the operating strokes of the press. Shells S (FIG. 12) to be converted are loaded onto belt 60 at the loading station indicated by general reference numeral 68 in FIGS. 1, 2 and 3, and the shells, when converted into finished ends, are unloaded from the nests at the unloading station indicated by the general reference numeral 70 (FIGS. 1 and 5), and located at the beginning of the lower flight of belt 60.

Figure 8:
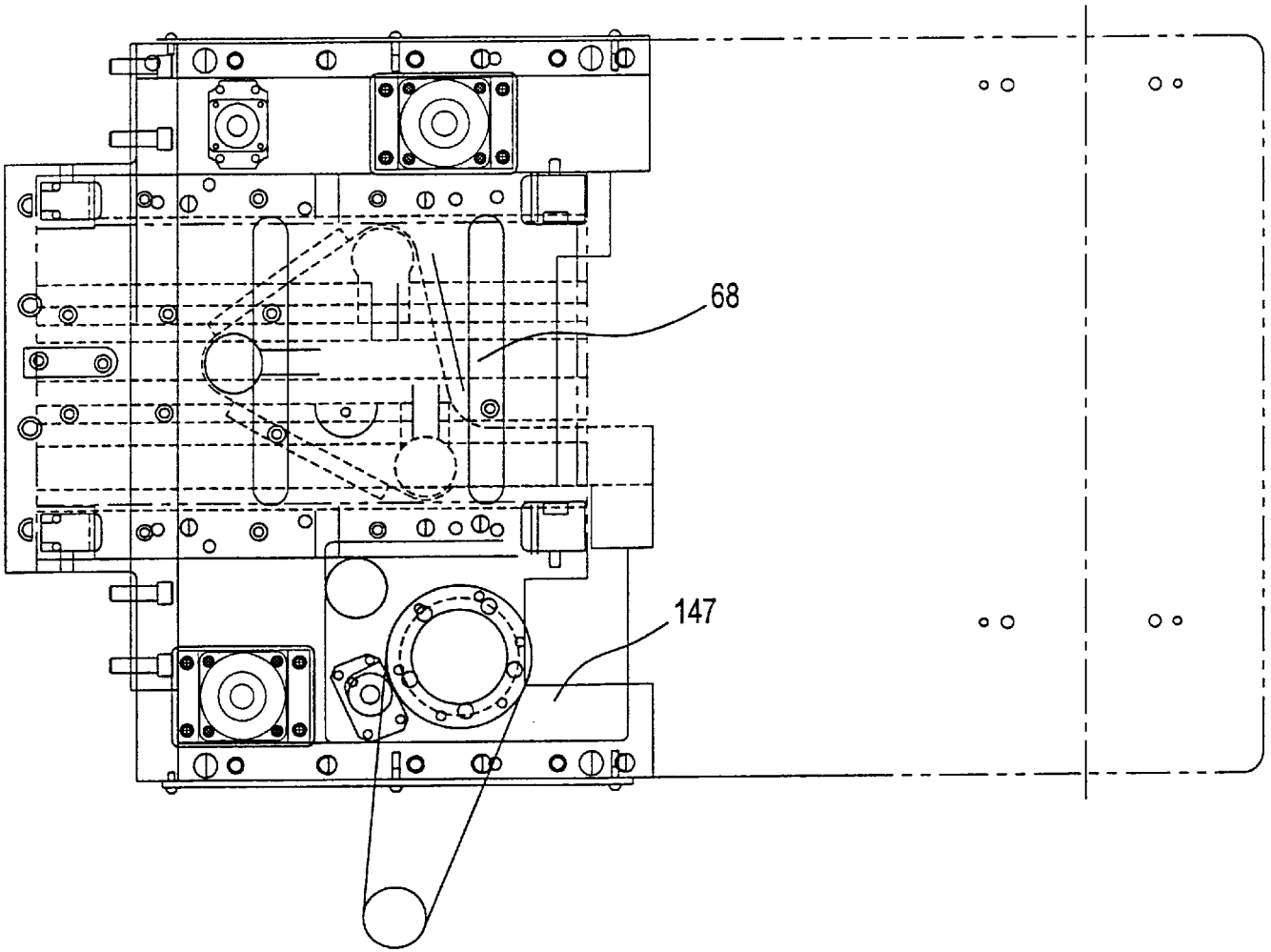
FIG. 8 is an enlarged plan view of the down-stacker or shell feeder device (down-stacker) at the entrance region of the upper flight of the transfer belt.

The loading mechanisms, generally described later, are also referred to in the art as a down-stacker mechanism, in reference to the manner in which this mechanism removes single shells from the bottom of a supply stack and places a single shell S into each nest at the loading station 68 (FIGS. 1, 2 and 8). At the discharge location, the finished ends are ejected into discharge lanes or chutes, later described.

Figure 10:
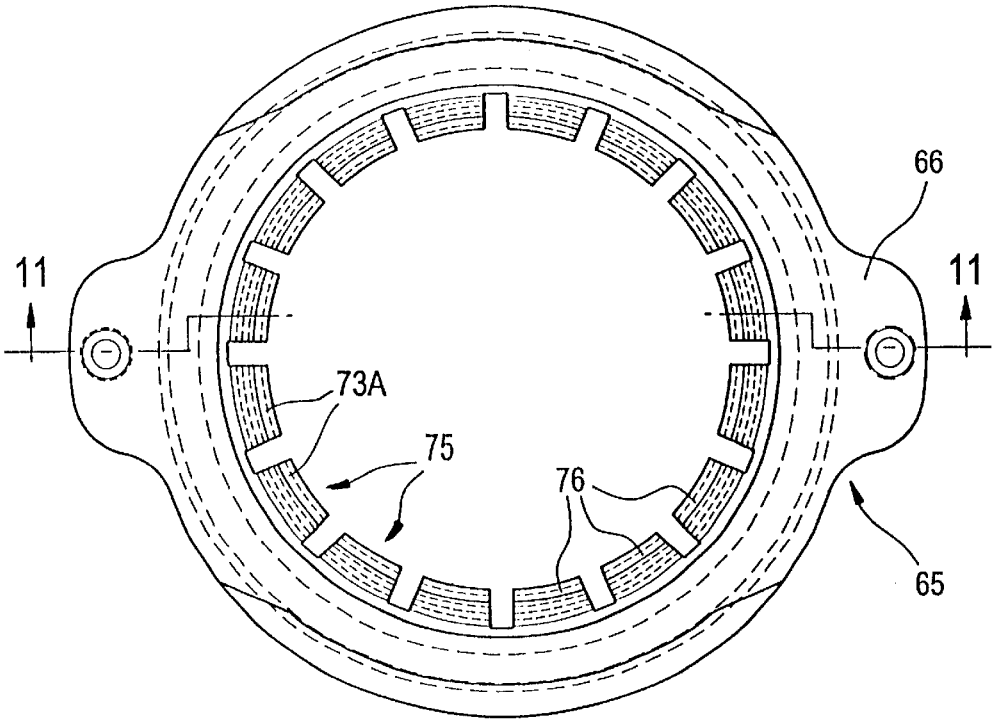
FIG. 10 is an enlarged top view of one of the nest structures.
Figure 11:
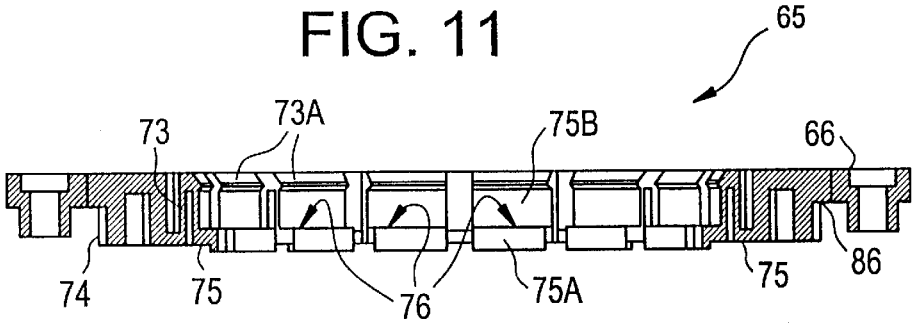
FIG. 11 is a cross-sectional view of one nest.

In the present system, the series of ring shaped nests 65 (preferably circular), are arrayed in lanes I, II and III, along flexible conveyor belt 60. Nests 65 have an underside 86 (FIGS. 11 and 12) which rests on belt 60 at the edge of openings 62 to define the vertical or height dimension of the nests in the belt. The nests have a rim 74 which is fitted into the corresponding opening 62, and include independently flexible gripping fingers 75 which are integral to rim 74 through flexible arms 73 and which present a discontinuous ledge 76 through which the curl C of an end shell S initially passes (FIGS. 10, 11 and 12).

Figure 6:
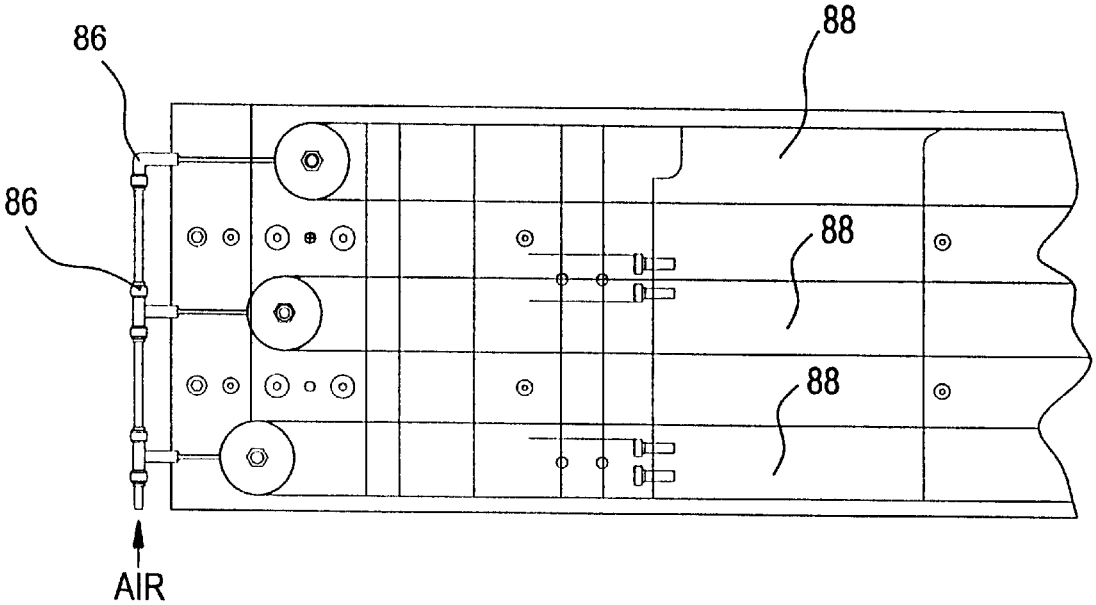

A shell is placed into a nest ring by moving the shell with the curl C upward and its central panel P and chuck wall CW facing downward (see FIG. 6). The curl C of the shell S is pulled through the inward and downward tapered fingers 75 and onto the lower rim. The bottom of the shell, including the lower end of its chuck wall CW and the central panel P, is then located at the lower edge of the nest with curl C between the lower rim surface 71 and fingers 75.

Fingers 75 are somewhat extended or opened in a radially outward direction during this process, and then the fingers close inward entirely around and over the shell curl C, so as to exert a centering force on the shell as it is loaded into the nest, and to hold it securely about its entire periphery. This retains the shell especially against turning while various operations are performed on it and a tab is attached to it, as the shell progresses through the tooling stations.

A vacuum box 78 is located beneath the loading station and creates a differential in air pressure between the top and bottom of each shell as it is placed onto nests 65, thereby placing or locating the shells onto the nests. Thereafter the shells are positively inserted into the nests and subsequently controlled by the nests; no further vacuum retention is needed as the shells progress through the tooling stations.

Belt 60 has rows of teeth or lugs 61 on its underside to mate with teeth 55T on driving drum 55 and 57T on idler and guiding drum 57. Thus belt 60, in passing around these drums, is guided into an upper flight 60A extending from the idler drum 57, and lower return flight 60B (see FIG. 1). One or more air cylinders 83 urge idler drum 57 in a direction away from the drive drum 55, to maintain a predetermined tension in the belt, particularly along upper flight 60A.

The attachments between nests 65 and belt 60 allow for limited controlled relative movement of the nests, but only in directions tangent to the turns of the belt about the drums, thus the nests remain flat about the turns and can carry parts (the shells and resultant ends) about drum 55 from the upper to the lower belt flights.

The upper flight 60A of the belts is lifted upward by a spring biased lifter pad 84 when the press is opened, and the belts and attached nests 20 are moved incrementally forward over the lifter pad, to locate nests 65 successively in alignment with progressive tooling stations or sets 35, 36 of the can end conversion tooling (FIGS. 1 & 2). As the press closes, the lifter pad descends and causes the upper flight 60A to lower the nests therein, and the end shells S therein, onto the lower tooling 36 while pilot mechanisms (not shown) align the nests precisely with respect to the tooling before it closes. Guide rails 84R on the upper surface of pad 84 maintain centering of the upper flight 60A with respect to the tooling as that flight advances through the tooling.

In the illustrated embodiment of the invention, there are three lanes I, II, III of regularly spaced multiple nests 65 in a single flexible reinforced rubber composite belt. As mentioned, it is possible to use slightly spaced apart multiple belts each with multiple lanes of nests, all mounted around common drive and idler drums. Shells are rotary loaded [or down-stacked] near the beginning of the upper flight 60A of the conveyor by down-stacker mechanisms, at the left in FIGS. 1, 2 and 13. The vacuum box 78 under this region of the belt path produces a differential pressure which tends to pull each shell into a nest. The shells are positively snapped in place and firmly held against rotation as they are transferred through the conversion tooling.

A positive insertion mechanism is provided in the form of three insertion assemblies 85 of like construction, each comprising a mounting bracket 85B extending from punch plate 38A, a shaft 85S, a riser 85R on the bottom of shaft 85S, and an insertion head 85H of a suitable plastic material which has is lower face shaped to conform generally to the inner upper surface of a shell placed in a nest. These insertion heads are dimensioned and arranged to push a shell positively into engagement with the internal teeth of each nest, one drive increment before it passes into the tooling. the After conversion the ends travel around drum 55 and then are ejected from the nests and moved, by force from air stream(s) 87 along the chutes 88 to conveyors familiar in end making facilities.

Conveyor and Tab Strip Drive

The power takeoff shaft 45 is connected via pulley 90 and belt 92 to a further shaft 95 extending across the rear of the press bed. This shaft actually comprises several sections. First section 95A is supported in bearings 97 and carries pulley 98 driven by belt 92. Second shaft section 95B is connected through coupling 101 to the input of right angle gear drive unit 100, and through that unit and a further coupling 102 to third shaft section 95C. A further coupling 104 (FIG. 4) is connected to the right angle output of gear drive unit 100, to drive a shaft 105 which is supported in depending bearing mounts 107. The shaft 105 drives a pair of pulleys 108, and also drives an eccentric 110. The purpose of these driven items is explained hereafter.

Shaft section 95B is connected by the further coupling 112 (FIGS. 3 and 4) to another shaft section 115C, which is supported in suitable bearings 114, and this shaft section in turn drives a final shaft section 105D through an overload friction-type clutch 116. The final shaft section 105D is supported in bearings 117 below and rearward of the discharge station 68, and a pulley 118 and belt 119 provide power to that station.

Tooling Layout

Figure 13:
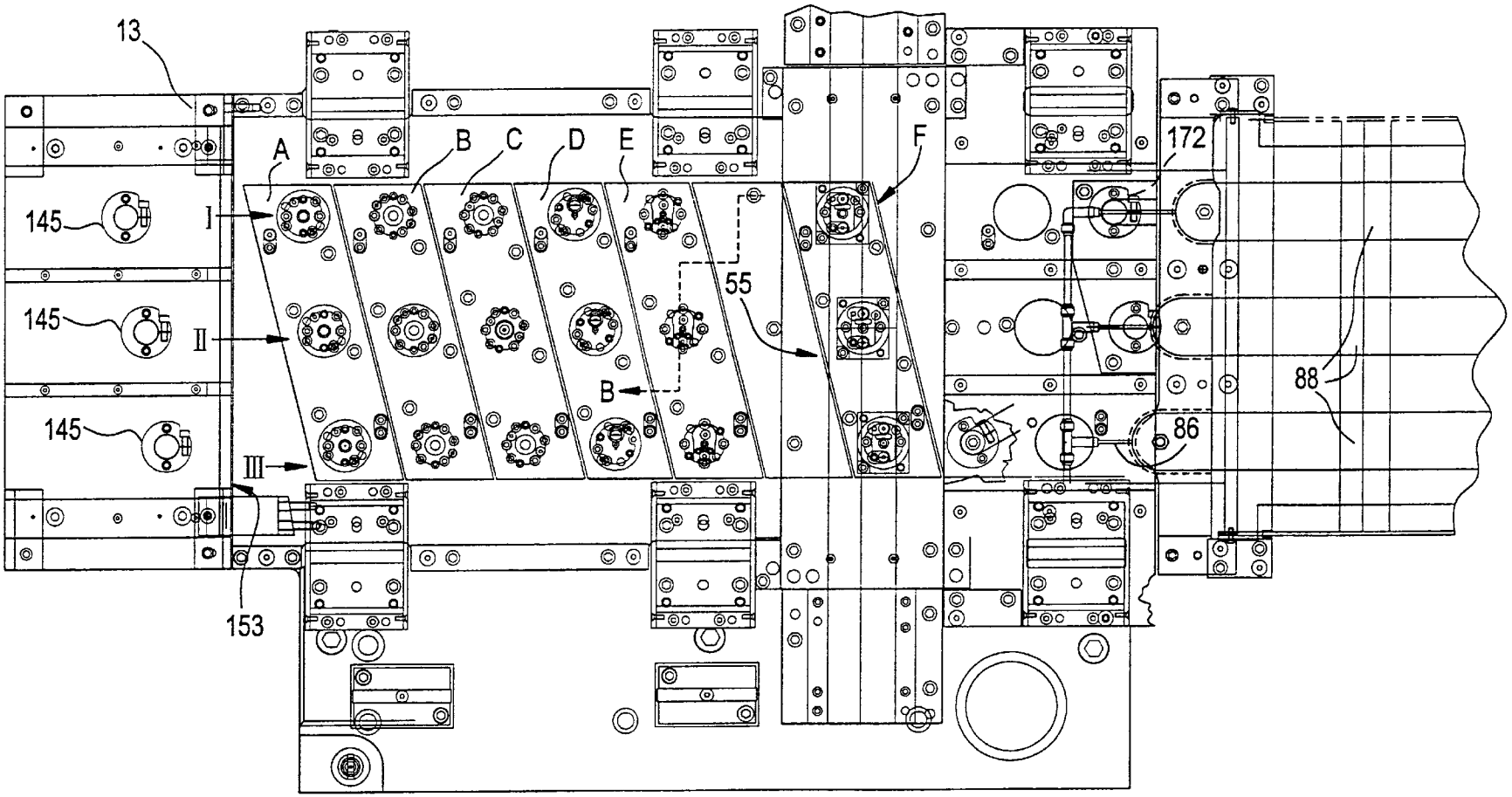
FIG. 13 is an enlarged plan view of a typical embodiment of the tooling station shown in FIG. 2.

FIGS. 1, 2 and 13 illustrate general details of the upper and lower tooling sets 35, 36.

The punch holder plate 37A is fastened to the bottom surface of the slide 30, and a die shoe or plate 38A is supported below, in the space between the flights of belt 60. The die shoe and the punch holder plate are provided with conventional cooperating stop blocks which provide limits for the closed position of the tooling (in known manner) and the punch holder plate is fitted with guide rods arranged generally near the four corners of the rectangular parts of the tooling, and extending downward into receiving posts or sockets fitted to the die shoe. These include suitable precision bearing guides which assure the necessary high accuracy of interfit between the upper (punch) and lower (die) tooling parts.

Figure 9:
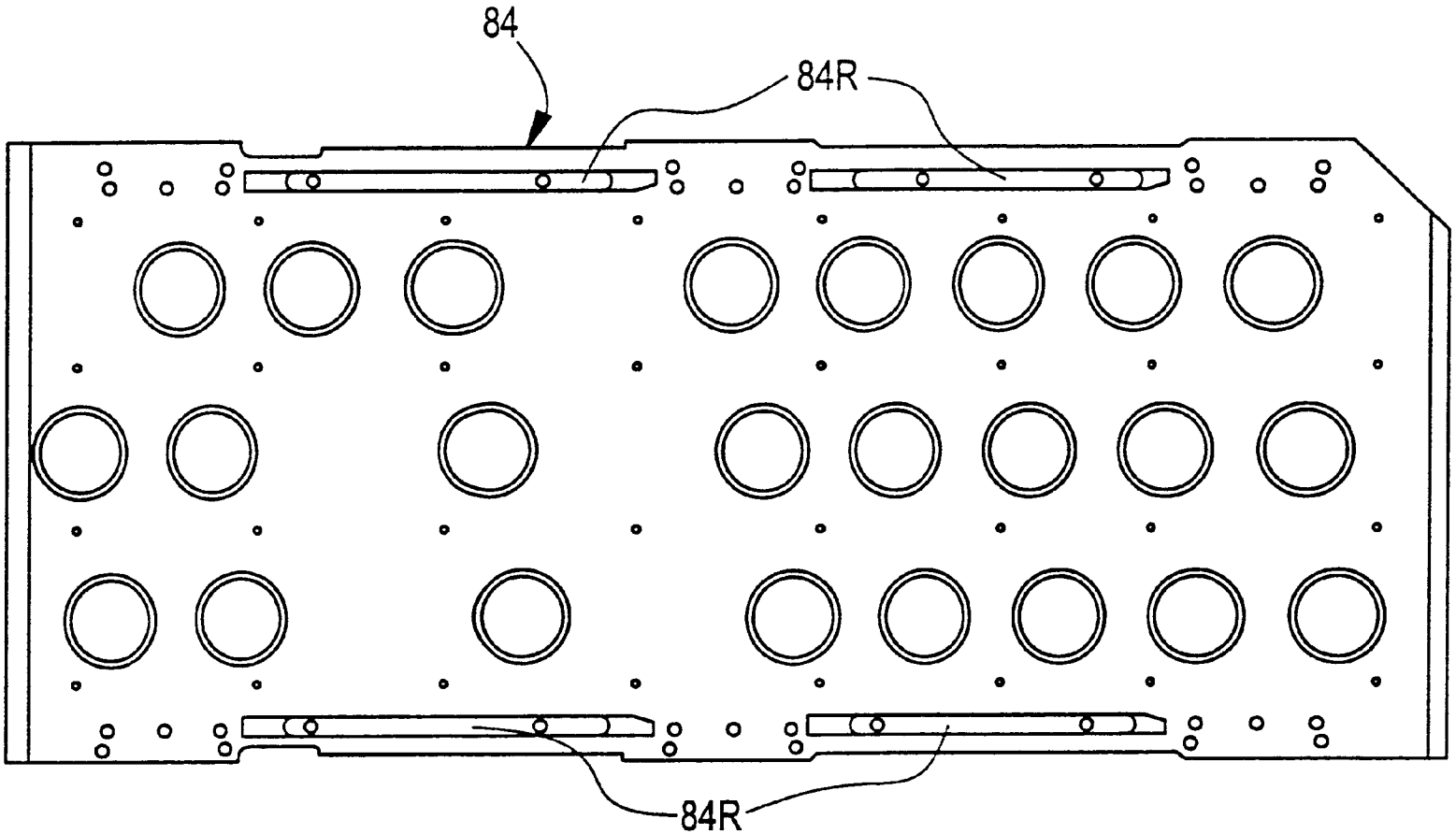
FIG. 9 is a plan view of the lifter pad for the tranfer belt located in the region where that belt traverses the tooling.

Conventional end conversion tooling is mounted on the die shoe, defining a plurality of stations arranged in multiple lanes, corresponding to the lanes of conveyor belt 60. Corresponding upper or punch tooling is mounted to the underside of punch holder plate 37A, above the die tooling on plate 38A. Thus shells placed in the apertures of the conveyor are carried progressively to the succeeding stations of the end conversion tooling by each step-wise movement of the conveyor. When the press opens (ram rises) conveyor 60 is indexed (left to right in FIGS. 1 and 2). Preceding conveyor motion, the stripper pad 84 (FIG. 9) is raised to guide the conveyor above the die tools. The end converting path thus defined extends from side to side of the press and the end conversion stations are laid out on the die shoe and punch holder plate in such fashion that they are generally symmetrically disposed with respect to the front to back center lines of the press, with the tab tooling at the side of the press, beyond the location of drive drum 55.

Referring to FIGS. 2 and 13, which show a one belt, three lane embodiment, the end conversion tooling stations are disposed in lanes I, II and III, and are identified as:

bubble stations: I-A, II-A, III-A
button station I-B, II-B, III-B
rivet forming station: I-C, II-C, III-c
score station: I-D, II-D, III-D
panel form station: I-E, II-E, III-E
transfer/stake station: I-F, II-F, III-F Details of the individual punches and dies are not shown since these will vary with any particular installation, and they are not necessary for an understanding of the present invention.

Referring to FIGS. 1, 2 and 13, in the end conversion tooling, there is provided a bridge 120 at the stake stations which receives the strip of partially formed tabs from the tab-tooling and carries the attached tabs across the end conversion tooling. The bridge consists of a bottom plate 121 with a front to back extending slot, and a cover 124 secured to the strip, whereby the slot 122 provides a closed passageway for a strip of material from which tabs are formed.

Thus, as particularly shown in FIGS. 2 and 13, the stations of the end conversion tooling, along with the conveyor, define a side-to-side end conversion path while the tab forming tooling defines a tab forming path in a front-back direction that is transverse to and beyond the end conversion path at a location beyond idler drum 57, and then loops back to carry the tabs into the transfer/stake station, as shown by the phantom lines in FIG. 2.

Shell Feed/End Discharge

The shell feeding mechanism 65, sometimes referred to as a downstacker, has been mentioned earlier with respect to its general function, and its location on the press (FIG. 3) outboard of posts 12 and 14. This mechanism is per se known, but a brief description of it is desirable to appreciate its function in the present invention.

There are multiple mechanisms, each designated by the general reference numeral 145, one each of which (as shown in FIGS. 1, 2 & 3) is mounted over the conveyor lanes I, II and III. For simplification only one will be described. The base plate 147 holds these mechanisms, and is mounted over conveyor 60, outside of the left side frame. A bottom plate 148, to which the base plate is bolted, includes vacuum chamber 78 (FIG. 1) to which a vacuum hose fitting 151 is attached from a vacuum lower VB. Plates 147 and 148 are recessed to define a shallow passageway 153 receiving the conveyor belt 60.

Above chamber 150 there are circular feed opening of a diameter just large enough to pass the shells S which descend from a stack thereof contained within guide rods. The lowermost shell S has its lip supported on the feeding threads of three feed screws spaced around each feed opening such that one full rotation of these screws will carry the lowermost shell from the stack and deposit the shell in a nest 65 located beneath the feed opening.

The power and timing for the feed screw rotation is derived from a belt which is driven from power take-off shaft section 45 as earlier described.

By proper selection of pulley sizes and gear sizes, teeth numbers, and ratios, the intermittent rotation of the shaft is translated into 360° rotations of feed screws 158, and a single shell is deposited in a nest 65 as those openings halt under the feed opening.

Tab Tooling and Attachment

As previously mentioned the tabs are formed from a strip of aluminum or like material, supplied from a roll and directed along the tab forming path which is transverse to the end conversion path. This strip is advanced through the tab forming tooling, 37A, 37B, forms a reverse loop, passes back through the guide 160A (FIG. 2) into the stations I-F, II-F, III-F and the remaining scrap strip is cut into suitable pieces and discharged.

In known manner, the rivet holes in the tabs located at this station are thus aligned with the button or rivet on the ends, and as the tab strip connections are severed, the tabs are set onto the ends. Complete closing of the tooling finishes the attachment by staking the rivets to form the well-known integral rivet attachment between the tabs and ends. After the final tooling station operation the end conversion is complete and the ends proceed around drum 57 to the unloading mechanism. The remainder of the strip 115 proceeds to a cutter (not shown) where the strip is cut into short lengths as it is fed incrementally. These scrap lengths can be suitably collected for reclaiming, in known fashion.

The conveyor belt 60 is taut in the upper flight and level across the lifter pad. In this position the belt advances only after the lift movement has stopped. The finished ends are carried in nests 65 around the drum 57 into the beginning of the return flight. Discharge chutes 88 (FIGS. 5–7) extend from a location below the beginning of the return flight to a location through and beyond the press frame.

Figure 5:
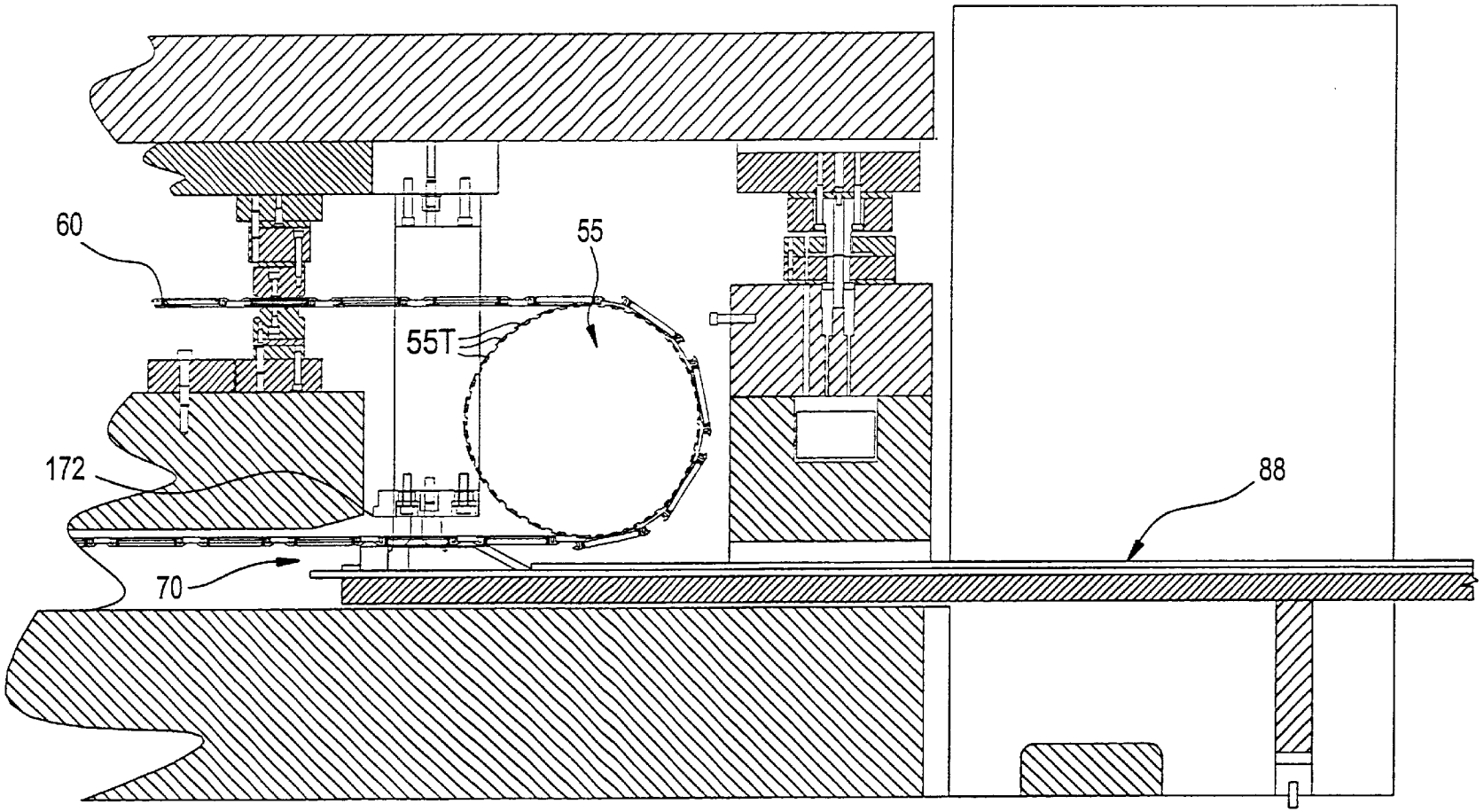
FIGS. 5, 6 and 7 are, respectively, side, top, and end views of the mechanism for discharging container ends from the system.
Figure 7:
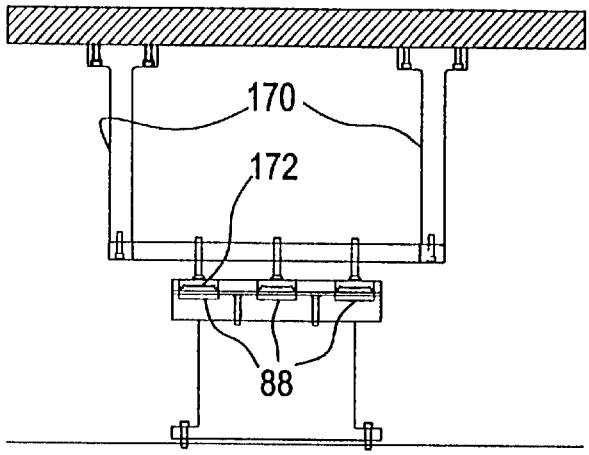

A knock-out device, extending into the space between the belt flights 60A, 60B, includes a bracket 170 attached to the press ram (FIGS. 5 and 7). Knock-out rings 172 are positioned such that when the ram descends, finished ends are ejected from the nests onto chutes 88 where they are carried by air streams, from a compressed air pipe 86, to the end of the chutes.

Another advantage of this invention is that it enables producing ends of as many different sizes as there are lanes of nests in the belt. The nests are spaced according to the tool station center lines, which is also the indexed movement of the belt. The retainers or ears on the nests intersect these center lines by providing nests in one or more lanes which have greater or lesser radii of their ears, it is possible to handle shells, and produce ends, of different sizes simultaneously.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. A conveyor system for can end conversion equipment, comprising at least one relatively narrow width endless belt, means supporting said belt in a loop path including upper and lower flights, means for moving said belt in a predetermined direction with an intermittent motion through predetermined increments, a plurality of nests positioned extending across said belt and extending in at least one lane longitudinally of said belt, said nests being attached to said belt along centerlines which are perpendicular to the loop path of said belt whereby each nest can traverse the portions of the loop path between said upper and lower flights, each said nest having at least one nest ring for receiving and securely holding a can end shell, the nests rings in the respective nests being aligned along said at least one lane longitudinally of said belt, said nests rings of successive nests being spaced apart a common distance which is equal to the increment of motion of said at least one belt, means for raising and lowering a section of said belt and attached nests along said upper flight of said belt during each incremental motion thereof, and means for unloading can end shells from said nests at the beginning of the lower flight of said belt.

2. In a conveyor system for can end shells being processed into easy open can ends in a conversion apparatus, said conversion apparatus including progressive tooling for working on end shells, said tooling being arranged in successive stations along a predetermined path; the improvement comprising a conveyor belt having regularly spaced openings therein spaced apart corresponding to the spacing of the tooling stations, said openings extending along at least one lane extending longitudinally along said belt, first and second drums supported respectively at opposite ends of said predetermined path to define upper and lower flights of said conveyor belt, end shell carrier nests fitted into said openings in said belt, said nests including an array of flexible fingers adapted to engage the periphery of a shell to hold the shell therein during conversion work on the shell as the shell is passed through said tooling, attachment means on each of said nests fastening the respective said nest to said belt along a line transverse to said belt to allow each said nest to pass around said drums, a loading station along said upper flight of said belt located between said first drum and the first of said tooling stations, means at said loading station for presenting an end shell to each nest located at said loading station, means cooperating with said belt at said loading station to place a presented end shell onto said fingers, and means for raising and lowering a section of said belt and attached nests along said upper flight of said belt at all of said tooling stations during each incremental motion thereof.

3. A conveyor system as defined in claim 2, wherein said means for placing an end shell includes a vacuum box below said belt upper flight at said loading station to draw an end shell onto said fingers of the nest located at said loading station.

4. A conveyor system as defned in claim 3, further including insertion means located between said loading station and the first of said tooling stations and driven synchronously with said progressive tooling to insert the end shell into full engagement with said fingers of said nest.

5. A conveyor system as defined in claim 1, further including means defining an unloading station beneath said lower flight of said at least one belt whereby each easy open end processed through said tooling is carried about said second drum to said unloading station, and means at said unloading station for ejecting converted easy open ends from said nests.

6. A conveyor system as defined in claim 2, wherein said nests each include a base ring having a peripheral ledge dimensioned to seat upon the edge of said openings in said belt, and said fingers are integral inwardly projecting extensions from said base ring and are spaced apart around the interior of said base ring.

7. A conveyor system as defined in claim 6, wherein said fingers include shoulders thereon defining an interrupted circular surface adapted to press against the periphery of an end shell to retain the shell stationary in the nest whereby the shell is retained solely by inwardly directed pressure of said fingers.

* * * * *